United States Patent [19]

Tomita et al.

[11] 4,385,907

[45] May 31, 1983

[54] RESINOID BONDED GRINDING WHEEL WITH SUPPORT MEMBER MADE OF A HEAT INSULATING MATERIAL

[75] Inventors: Tamaki Tomita, Okazaki; Ikuo Suzuki, Chiryu; Tomoyasu Imai, Kariya; Masato Kitajima, Hekinan, all of Japan

[73] Assignee: Toyoda Koki Kabushiki Kaisha, Kariya, Japan

[21] Appl. No.: 179,985

[22] Filed: Aug. 21, 1980

[30] Foreign Application Priority Data

Aug. 22, 1979 [JP] Japan ..... 54-115420

[51] Int. Cl.[3] ..... B24D 3/18

[52] U.S. Cl. ..... 51/296; 51/298

[58] Field of Search ..... 51/298, 296

[56] References Cited

U.S. PATENT DOCUMENTS

| | | | |
|---|---|---|---|
| 2,150,886 | 3/1939 | Van Der Pyl | 51/298 |
| 2,947,617 | 8/1960 | Wentorf | 51/298 |
| 3,276,852 | 10/1966 | Lemelson | 51/298 |
| 3,615,302 | 10/1971 | Rowse | 51/298 |
| 3,779,727 | 12/1973 | Siqui et al. | 51/298 |
| 3,867,232 | 2/1975 | Sioui et al. | 51/298 |
| 4,035,161 | 7/1977 | Geissler et al. | 51/298 |
| 4,099,934 | 7/1978 | Suzuki et al. | 51/298 |

*Primary Examiner*—James H. Derrington

*Attorney, Agent, or Firm*—Oblon, Fisher, Spivak, McClelland & Maier

[57] ABSTRACT

A resinoid-bonded grinding wheel employing the ultra-hard abrasives such as cubic boron nitride or diamond are formed with a support member which is made of a heat insulating material such as ceramics for preventing a thermal expansion of the grinding wheel and maintaining a precision grinding operation.

1 Claim, 1 Drawing Figure

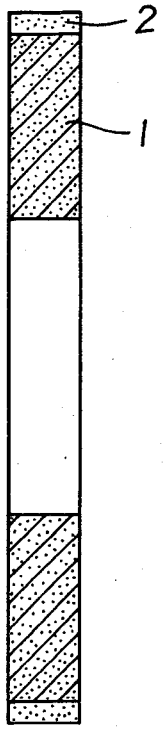
2
1

RESINOID BONDED GRINDING WHEEL WITH SUPPORT MEMBER MADE OF A HEAT INSULATING MATERIAL

BACKGROUND OF THE INVENTION

1. Field of the Invention

The present invention relates to resinoid bonded grinding wheels employing ultra-hard abrasives such as cubic boron nitride or diamond and more particularly to resinoid bonded grinding wheels with support members made of heat insulating materials.

2. Description of the Prior Art

A prior grinding wheel employing cubic boron nitride or diamond abrasives is generally formed with a metallic support member on which is affixed a grinding element consisting of cubic boron nitride or diamond abrasives bonded by a bonding matrix.

A grinding machine which is provided with such a grinding wheel is capable of a precision grinding operation even in a dead-stop grinding operation. However, since a support member is made of a metallic material, such as cast-iron or aluminum-base alloy, which has a relatively high thermal conductivity and a high rate of thermal expansion, the grinding wheel is caused to expand by heat transmitted from bearing members and the grinding area between the grinding wheel and a workpiece, thereby bringing inaccurate grinding results after grinding a certain number of workpieces.

It is, therefore, most advantageous to provide a grinding wheel wherein a support member is made of a heat insulating material which has a low thermal conductivity for preventing transfer of heat to the entire body of the support member and for preventing the thermal expansion of the grinding wheel.

SUMMARY OF THE INVENTION

It is, therefore, an object of the present invention to provide a new and improved grinding wheel which is not easily affected by heat generated during a grinding operation.

Another object of the present invention is to provide a new and improved grinding wheel having a support member which is made of a heat insulating material for maintaining a precision grinding operation.

Briefly, according to the present invention, there is provided a grinding wheel for use in grinding machines including a grinding element having hard grains such as diamond or cubic boron nitride distributed in a bonding matrix. The bonding matrix comprises phenol resin and fillers, and a support member is made of a heat insulating material and mounts thereon the grinding element.

BRIEF DESCRIPTION OF THE DRAWING

The foregoing and other objects and many of the attendant advantages of the present invention will be readily appreciated as the same becomes better understood by reference to the following detailed description when considered in connection with the accompanying drawing, and wherein:

FIGURE is a sectional view of a grinding wheel according to the present invention.

DETAILED DESCRIPTION OF THE PREFERRED EMBODIMENT

Referring to the drawing, a support member 1 is provided for mounting thereon a grinding element 2 which includes diamond or cubic boron nitride abrasive grains bonded by a bonding matrix.

In a method for manufacturing a resinoid bonded grinding element 2, abrasive grains are first mixed with powdered thermosetting resin used as a bond and with fillers and the mixture is press-formed on a surface of the support member 1 to a desired shape and is then thermally set by heating. Such a method is disclosed in U.S. Pat. No. 4,099,934.

Suitable resins are phenol resin, polyester resin and epoxide resin and, further, suitable fillers are nickel-coated graphite, alundum and carborundum. Such fillers are used to improve the strength of the bond or otherwise control its physical properties.

In the case of thermosetting phenol resin, the upper limit of the temperature during heating is about 185°–190° C. which is held for about 16 hours for the thermosetting step of the process.

In this embodiment, metal-coated abrasive grains are employed in order to enhance the mechanical strength of the grinding element 2, because they have a stronger affinity to resins than non-metal-coated grains do.

The support member 1 is made of ceramics as a heat insulating material. Ceramics is generally a product made essentially from a nonmetallic mineral by firing at high temperatures. The ceramics has a relatively low thermal conductivity, as compared with the conventional metallic support members which are made of aluminum-base alloy or cast-iron, so that the heat generated during a grinding operation is hardly transmitted to the entire body of the support member 1. Therefore, the grinding wheel according to the present invention keeps its diameter constant and is capable of maintaining a precision grinding operation.

Further, the ceramics has a relatively small coefficient of thermal expansion so that the diameter of the grinding wheel is not so badly increased even at high temperature which is caused by heat generated during a grinding operation. Therefore, the support member 1 made of ceramics is not easily affected by heat generated during a grinding operation and is capable of maintaining a precision grinding operation.

As one of the examples of ceramics, a vitrified grinding wheel may be used for making the support member 1, which vitrified grinding wheel contains white fused alumina or white aluminum oxide abrasive grains bonded by a vitrified bonding matrix and is generally used for grinding steel and hardened steel. This vitrified grinding wheel has a large number of pores so that it is effective to radiate heat generated during grinding operation, thereby keeping the diameter of the grinding wheel constant.

Ceramics for making the support member 1 is not limited to this vitrified grinding wheel but other ceramics products such as earthenware, porcelain and other grinding wheels may be used.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinding wheel for use in grinding machines comprising:

a grinding element having hard grains selected from the group consistng of diamond and cubic boron nitrides distributed in a bonding matrix;

said bonding matrix comprising phenol resin and fillers; and a support member made of a porous vitrified grinding wheel for mounting thereon said grinding element, said porous vitrified grinding wheel containing white fused alumina abrasive grains bonded by a vitrified bonding matrix and having such thermal properties of thermal conductivity and thermal expansion as to keep the diameter of said grinding wheel nearly constant irrespective of heat generated during a grinding operation.

* * * * *